US007481034B2

(12) United States Patent
Hoyos et al.

(10) Patent No.: US 7,481,034 B2
(45) Date of Patent: Jan. 27, 2009

(54) DOUBLE-JOINTED HORSE BIT

(75) Inventors: Ernst Hoyos, Cloppenburg (DE); Heinz Baumann, Iserlohn (DE); Valentin Völlmecke, Iserlohn (DE)

(73) Assignee: Herm. Sprenger GmbH & Co. KG, Iserlohn (DE)

( * ) Notice: Subject to any disclaimer, the term of this patent is extended or adjusted under 35 U.S.C. 154(b) by 338 days.

(21) Appl. No.: 10/589,997

(22) PCT Filed: Jan. 15, 2005

(86) PCT No.: PCT/DE2005/000050

§ 371 (c)(1),
(2), (4) Date: Aug. 17, 2006

(87) PCT Pub. No.: WO2005/077814

PCT Pub. Date: Aug. 25, 2005

(65) Prior Publication Data

US 2008/0047236 A1 Feb. 28, 2008

(30) Foreign Application Priority Data

Feb. 17, 2004 (DE) ..... 10 2004 007 864
Jan. 5, 2005 (DE) ..... 10 2005 000 776

(51) Int. Cl.
*B68B 1/06* (2006.01)

(52) U.S. Cl. ..... 54/9

(58) Field of Classification Search ..... 54/8, 54/9

See application file for complete search history.

(56) References Cited

U.S. PATENT DOCUMENTS 352,506 A * 11/1886 Sanborn ..... 54/6.1
392,998 A * 11/1888 Edwards ..... 54/8
532,455 A * 1/1895 Fisher ..... 54/8
544,917 A * 8/1895 Hart ..... 54/9
782,020 A 2/1905 Fitz Gibbons
823,565 A * 6/1906 Turton ..... 54/8
897,373 A * 9/1908 Jincks ..... 54/8
4,005,564 A * 2/1977 Simington ..... 54/8
4,375,147 A * 3/1983 Conrad ..... 54/8
6,425,229 B2 * 7/2002 Sprenger et al. ..... 54/9
2004/0200196 A1 * 10/2004 Hsi-Chang et al. ..... 54/9

OTHER PUBLICATIONS

International Preliminary Examination Report for PCT/DE2005/000050, filed Jan. 15, 2005.

* cited by examiner

*Primary Examiner*—Son T. Nguyen
(74) *Attorney, Agent, or Firm*—McCarter & English, LLP

(57) ABSTRACT

The invention relates to a double-jointed bit for horses, the bit comprising two outer lateral parts that are preferably embodied as rings, and a bit part that is arranged between the outer parts and connected thereto. The bit part has two lateral sections and an olive-shaped central section, the central section being connected to each of the two lateral sections by means of an articulated element. The articulated elements are formed by two articulated boreholes embodied in the central section and respectfully a loop provided in each lateral section. The central section comprises a base part and an additional part, the two articulated boreholes being embodied in the base part. The additional part is located essentially between the two articulated boreholes and forms an outer surface of the central section in the region of the central cross-section between the two articulated boreholes.

21 Claims, 3 Drawing Sheets

DOUBLE-JOINTED HORSE BIT

CROSS REFERENCE TO RELATED APPLICATIONS

This application is the U.S. National Phase of International Application No. PCT/DE2005/000050, filed Jan. 15, 2005, which claims priority to German Application No. DE 10 2005 000 776.7, filed Jan. 5, 2005, and German Application No. DE 10 2004 007 864.5, filed Feb. 17, 2004, the contents of which are expressly incorporated by reference in their entirety as part of the present disclosure.

BACKGROUND

The invention relates to a double-jointed horse bit with two outer side parts that are preferably configured to be rings and with a bit part interposed between and connected to the side parts, the bit part having two side portions and an olive-shaped central portion, the central portion being connected to each of the two side portions through a joint, the joints being formed from two joint holes formed in the central portion and from one eye each, provided in the side portion.

A such type bit is known from PCT/DE 99/02545. It has proved extremely efficient. An olive shape of the central portion is thereby to be understood to refer to a shape having on the one side a substantially circular shape in a cross section between the two joint holes and with the diameter of the cross section being on the order of half the entire length of the central portion on the other side. As a result, the central portion is similar to an ovoid and the two joint holes have quite a long hole length.

The reader is further referred to the snaffle bit disclosed in EP-A-17 959. Finally, he is also referred to the bits described in U.S. Pat. No. 4,005,564; GB-A-7712/1914, GB-A-65/1913 and DE-C-194071.

It has been found particularly advantageous to configure the bit part with soft, edgeless flowing contours and to provide for smooth transitions between the various portions. A cross section of the side portions tapering from the outer side parts inward, toward the central portion, has also been found advantageous and is preferably maintained. The same applies to the curved configuration of the bit part according to which a central line of the shackle, which connects the outer holes for freely movably receiving the two outer side parts, describes a curve toward the front and the horse's palate. With the bit of the type mentioned herein above, this feature is achieved in that it has two joints allowing the formation of a curve. Double-jointed bits refer to bits having a bit part with two joints.

While including the essential features of the horse snaffle bit of the type mentioned herein above, the present invention would like to improve a horse bit in such a manner that it is adapted to even more benefit and advantage to a horse for improved fit in the horse's mouth. For, with the horse snaffle bit of the type mentioned herein above, it has been found that the pressure exerted by pulling on the reins not always acts onto the tongue of the horse only, but also in parts onto the palate. A pressure onto the palate however is not desired.

This is where the invention comes in. Its objective is to improve the bit of the type mentioned herein above so as to improve the fit for a horse and so that a pull on the reins, which is introduced through the rings, acts substantially onto the tongue. It should be made certain that the bit can fit the anatomy of a horse's mouth in the best possible manner. Moreover, it should find good acceptance with the horse.

SUMMARY

This object is solved by a bit comprising two outer side parts that are preferably configured to be rings with a bit part interposed between and connected to the side parts, the bit part having two side portion. The bit further comprises a central portion, the central portion being connected to each of the two side portions through a joint, the joints being formed from two joint holes formed in the central portion and from one eye each, which is provided in every side portion, and the central portion has a base part in which the two joint holes are formed. Further, the bit comprises a ring, wherein the ring is substantially located between the two joint holes and is bounded by radial surfaces, the ring has an outer diameter A, an axial width B, and an axial hole having an inner diameter L and a peripheral groove for movably receiving the ring and for securing the ring from being lost is formed in the base part, the groove having an axial width W that is slightly greater than the axial width B, the base portion has, in the region of the groove, a core diameter D that is smaller than the inner diameter L of the hole. Still further, the bit comprises a rim, which bounds the groove, the rim having a rim diameter R that is not greater than the outer diameter A, wherein the core diameter D is at least one millimeter smaller than the inner diameter L of the hole and the ring is allowed to radially move back and forth, and that twice the hole diameter L is smaller than the sum of the rim diameter R plus core diameter K and the hole is always hidden.

Having the central portion formed in two parts provides for an important improvement over the bit of the type mentioned herein above. It finds better acceptance with the horse. This is more particularly due to the fact that the central portion is formed from two parts. Two alternative possibilities are proposed for implementing the additional part, the additional part being a ring in the one implementation and in the other implementation, a body made from a soft elastic material that is connected with the base part of the central portion. In both cases, when the additional part is placed into the horse's mouth, the horse surrounds with its tongue the part configured to be a ring and can move it. The additional part configured to be a soft elastic body offers the horse's tongue a soft resistance and a non-metallic surface.

With the additional part being configured like a ring, improved relaxation of the horse's tongue muscle over the prior art bit was observed. This leads to a relaxation of the entire upper line formed by the horse's neck and back. With horses always getting their tongue over the bit, the best results were achieved with softer bits.

The bit in the configuration having an elastic body as an additional part clams agitated horses. Tooth grinding stops, horses trying to stick their tongue out of the side of their mouth readily accept the bit.

In a preferred embodiment, each side portion has one outer hole. The outer holes are defined by outer axes, the two outer axes spanning a first plane. The two hinge holes of the central portion have parallel hole axes which define a second plane that intersect the first plane at an angle of about 45° plus/minus about 20°. As a result, the bit is articulated in a second plane, which extends at right angles with the plane of the joint holes. This allows for improved fit of the bit in a horse's mouth and for higher degrees of freedom of movement over a normal bit. The bit more particularly has a clearly improved fit, acts more strongly onto the horse's mouth and fits better the anatomy of the horse's mouth.

In a preferred embodiment, the sum of core diameter D and outer diameter A is not smaller than the sum of rim diameter R and hole diameter L. This is achieved in that the ring is set back nowhere with respect to the base part, meaning that it is not allowed to sink deeper into the groove than the diameter of the groove's rim.

In a further improvement, it is proposed that twice the hole diameter L is smaller than the sum of the rim diameter R plus core diameter K. As a result, the hole cannot protrude with respect to the hole rim, so that the hole always remains invisible.

In a preferred improved implementation, the central portion has a maximum length of about 4 cm, preferably a maximum length of about 3 cm. The two hole axes of the joint holes of the central portion are also preferably in close neighbourhood, the axes being spaced preferably less than about 2.5 cm, more specifically less than about 2 cm, apart. As a result, the central portion is quite short and the two joints of the bit part lie quite close together.

BRIEF DESCRIPTION OF THE DRAWINGS

Further advantages and features of the invention will become apparent from the other claims and from the following non restrictive description of embodiments of the invention, given by way of example only with reference to the drawing. In the drawing:

DETAILED DESCRIPTION

Figure 1:
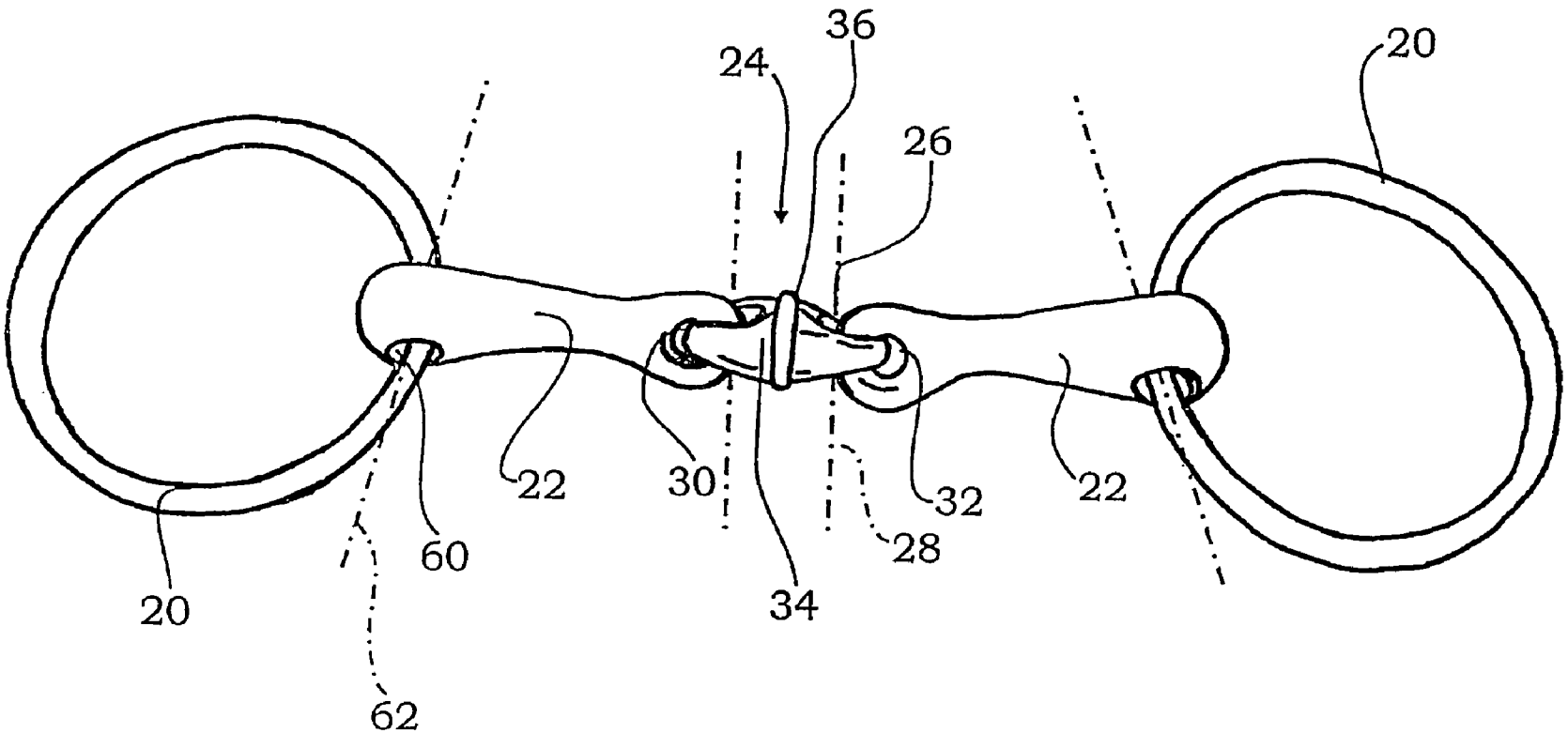
FIG. 1 is a perspective view of a bit that has been placed onto a level surface, such as a table.
Figure 2:
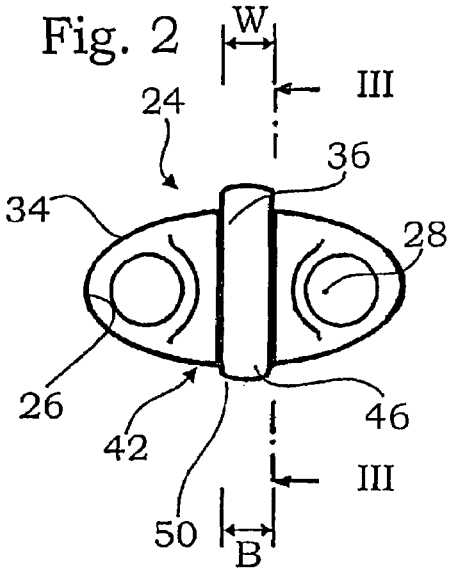
FIG. 2 is an enlarged top view of a central portion as it is inserted in similar fashion in FIG. 1.

The bit of FIG. 1 has two outer side parts 20 that are configured to be rings in the present case. Between these side parts 20 and connected thereto, there is disposed a bit part that is composed of two side portions 22 and one central portion 24 in the configuration as shown. The central portion 24 has two joint holes 26 that lie on hole axes 28. The two hole axes 28 are located in the same plane, parallel to each other. They are spaced about 2 to about 2.2 cm apart. The total length of the central portion is approximately 3.8 cm.

In the neighboring end regions of the side portions 22, there are configured eyes 30, which are defined by eye axes 32. Each eye 30 forms a joint with a respective one of the joint holes 26. The eye axes 32 span a third plane, which is perpendicular to the first plane spanned by the hole axes 28.

The central portion has a base part 34 and an additional part 36, which is configured here to be a ring. The base part 34 is made from the same metal as the side portions 22. The base part 34 forms the joint hole 26. The additional part 36 is located between the two joint holes 26. It determines the outer face of the central portion in the region of the largest cross section, which lies in the center between the two joint holes.

Figure 4:
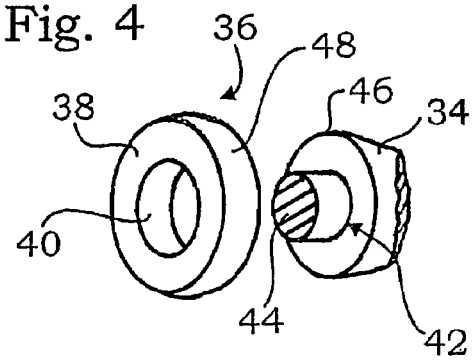
FIG. 4 is a perspective illustration of the region in which the section shown in FIG. 3 has been taken, for clarity of illustration.

The additional part 36, which is configured to be a ring, is limited by radial faces 38; in this context, the reader is referred to FIG. 4 in particular. The ring has an outer diameter A and an axial hole 40, which has an inner diameter L. The ring has an axial width B.

Figure 3:
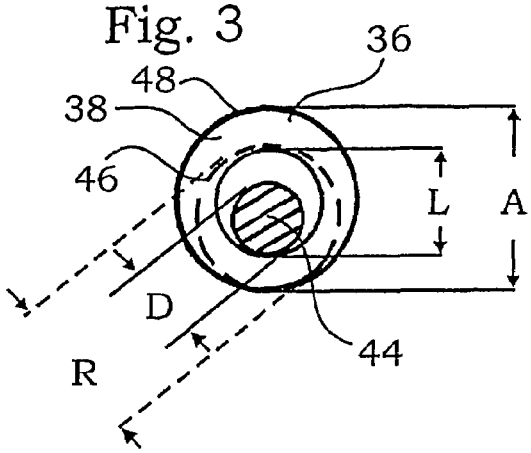
FIG. 3 is a sectional view of FIG. 2 according to the conditions III-III.

In the base part 34, a groove 42 is formed for the ring, which is movably received and secured from being lost in the groove 42. The groove 42 has an axial width W that is slightly greater than the axial width B so that the ring is not clamped axially. The base part 34 further has a connecting web 44 for holding the base part together, the web having a core diameter D. The groove 42 is limited by a rim 46 that has a rim diameter R. As shown in FIG. 3, the rim diameter is at least one millimeter smaller than the outer diameter A of the ring. The core diameter D in turn is at least one millimeter smaller than the inner diameter L of hole 40. As a result, the ring is allowed to radially move back and forth. FIG. 3 shows an eccentric extreme position. FIG. 4 outlines a central position.

The axial width B of the ring preferably ranges between about 2 mm and about 10 mm, with thicknesses ranging from about 7 mm to about 8 mm being preferred. In a preferred embodiment, the ring has a patterned outer surface 46; this surface is for example riffled, roughened or structured in another way. This provides for good acceptance of the surface with the horse's tongue. The outer diameter A of the ring is at least one millimeter greater than the rim diameter R. As a result, the ring may project accordingly from the rim 46, as outlined in FIG. 3. The outer rim of the ring is limited by a curved line 50, with the ring being, in any case, rounded at its exposed outer side and having no sharp edges.

Figure 7:
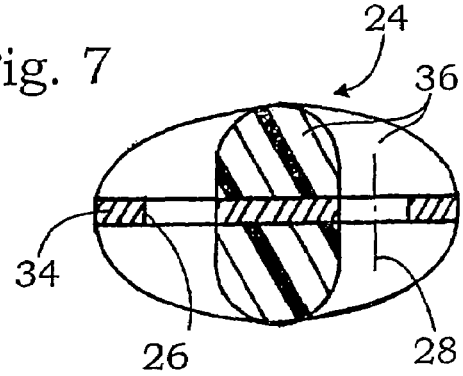
FIG. 7 is a sectional view through a central portion in another configuration.
Figure 5:
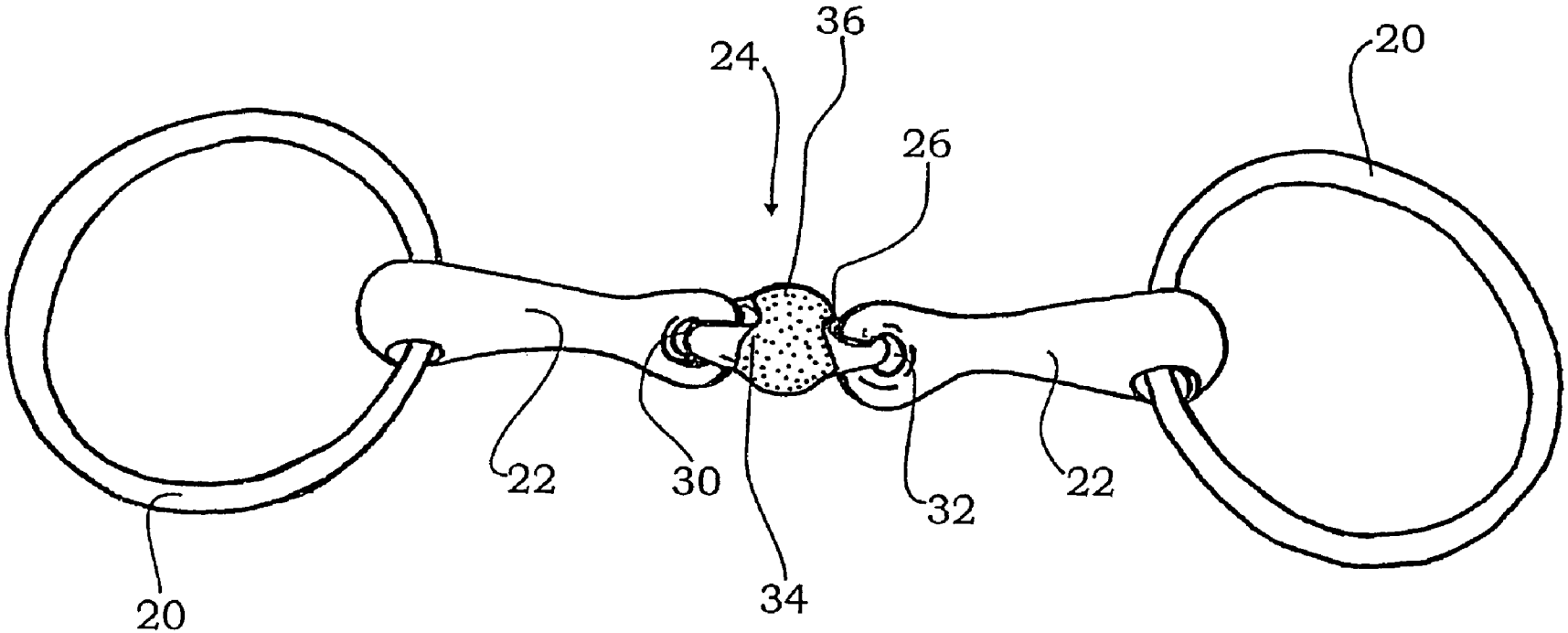
FIG. 5 is a perspective illustration of a second implementation of the bit in a view as shown in FIG. 1.

FIG. 5 shows an implementation in which the central portion 24 has an additional part 36 in the form of a body made from a soft elastic material. The hardness of the material is within the range of that of foam. Foam rubber, soft caoutchouc, soft plastic material and the like are used for example. The base part 34 can be configured in any manner. Typically, it is flat, as shown in FIG. 7. The additional part 36 is applied and connected to the base part 34 in such a manner that the connection cannot be released, not even by repeated work of the horse. The additional part 36 forms the essential part of the outer surface of the central portion 24. The material used is a closed-pore plastic material. It is preferred that the surface of the additional part 36 be closed in order to prevent liquid penetration.

Figure 6:
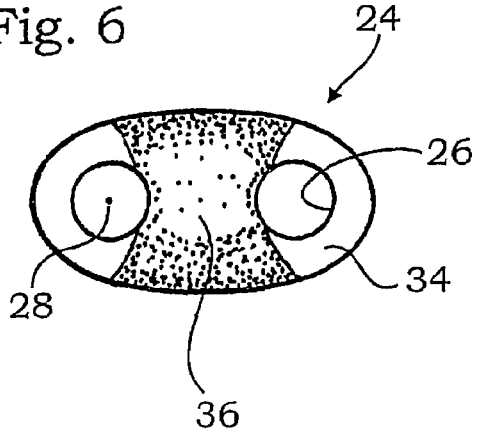
FIG. 6 is an illustration like FIG. 2 for a central portion as it is inserted in similar fashion in the implementation as shown in FIG. 5.

In the implementation as shown in FIG. 6, the additional part 36 is substantially interposed between the joint holes 26. The base part 34 is a flat plate with two holes. Preferably, it has the shape of an eight. In the implementation as shown in FIG. 7, the additional part 36 substantially forms an ovoid, with the base part being surrounded except for the regions of the joint holes 26. A section lying in the second plane is shown.

Each side portion 22 has an outer hole 60. These holes are defined by outer axes 62. The outer axes span a first plane. The hole axes 28 of the central portion 24 span a second plane extending at an angle of about 45°+/− about 20° with respect to the first plane.

The disclosure content of PCT/DE99/02545 is fully incorporated in the disclosure of the present invention.

As may be recognized by those skilled in the pertinent art based on the teachings herein, numerous changes and modifications may be made to the above-described double-jointed horse bit without departing from the spirit and scope of the invention as defined in the appended claims. For example, dimensional, angular and special attributes of the interrelated components and features of the bit, as well as the materials used for making the components and features, can be altered, adjusted and adapted for the specific animal, not limited to horses, that the bit is being used on. Accordingly, this detailed description is to be taken in an illustrative, as opposed to a limiting sense.

What is claimed is:

1. A double-jointed horse bit comprising:

two outer side parts that are configured to be rings; and a bit part interposed between and connected to the side parts, the bit part having two side portions;

a central portion, the central portion being connected to each of the two side portions through a joint, the joints being formed from two joint holes formed in the central portion and from one eye each which is provided in every side portion, and the central portion has a base part in which the two joint holes are formed;

a ring, wherein the ring is substantially located between the two joint holes and is bounded by radial surfaces, the ring has an outer diameter A, an axial width B, and an axial hole having an inner diameter L;

a peripheral groove for movably receiving the ring and for securing the ring from being lost is formed in the base part, the groove having an axial width W that is slightly greater than the axial width B, the base portion has, in the region of the groove, a core diameter D that is smaller than the inner diameter L of the hole; and the groove is bounded by a rim having a rim diameter R that is not greater than the outer diameter A, wherein the core diameter D is at least one millimeter smaller than the inner diameter L of the hole and the ring is allowed to radially move back and forth, and that twice the hole diameter L is smaller than the sum of the rim diameter R plus core diameter K and the hole is always hidden.

2. The bit as set forth in claim 1, wherein the base part and the two side portions are made from metal.

3. The bit as set forth in claim 2, wherein the ring has an irregular peripheral outer surface that is fluted, riffled or roughened.

4. The bit as set forth in claim 1, wherein the width B ranges from about 1 mm to about 10 mm.

5. The bit as set forth in claim 4, wherein the width B ranges from about 5 mm to about 8 mm.

6. The bit as set forth in claim 1, wherein the outer diameter A is at least 2 mm greater than the rim diameter R.

7. The bit as set forth in claim 1, wherein the outer diameter A is at least 3 mm greater than the rim diameter R.

8. The bit as set forth in claim 1, wherein the sum of the core diameter D and the outer diameter A is not smaller than the sum of the rim diameter R and the hole diameter L.

9. The bit as set forth in claim 1, wherein twice the hole diameter L is smaller than the sum of the rim diameter R plus the core diameter K.

10. The bit as set forth in claim 9, wherein twice the hole diameter L is about 1 mm smaller than the sum of the rim diameter R plus the core diameter K.

11. The bit as set forth in claim 1, wherein the ring has a peripheral surface that is bounded by a curved line in an axial sectional view.

12. The bit as set forth in claim 1, wherein each side portion includes an outer hole defined by outer axes spanning a first plane, the two joint holes of the central portion have parallel hole axes defining a second plane and the first plane extends at an angle of about 45° plus/minus about 20° with respect to the second plane..

13. The bit as set forth claim 1, wherein each side portion includes an outer hole defined by outer axes spanning a first plane, the two eyes are defined by eye axes spanning a third plane and the first plane extends at an angle of about 45° plus/minus about 20° with respect to the third plane.

14. The bit as set forth in claim 1, wherein the central portion has a maximum length of about 4 cm.

15. The bit as set forth in claim 1, wherein the central portion has a maximum length of about 3 cm.

16. The bit as set forth in claim 1, wherein the hole axes of the two joint holes of the central portion are spaced less than about 2.5 cm apart.

17. The bit as set forth in claim 16, wherein the hole axes of the two joint holes of the central portion are spaced less than about 2 cm apart.

18. The bit as set forth in claim 1, wherein each side portion includes an outer hole defined by outer axes spanning a first plane, such that, when the bit is stretched, each outer axis forms an angle of less than about 90° with a longitudinal axis of the bit part in the first plane, and that the two outer axes of the outer holes form the same angle with the longitudinal axis.

19. The bit as set forth in claim 18, wherein each outer axis forms an angle between about 60° and about 85° with the longitudinal axis of the bit part in the first plane, and the two outer axes of the outer holes form the same angle with the longitudinal axis.

20. The bit as set forth in claim 1, wherein each side portion includes an outer hole defined by outer axes, and the outer axes of the outer holes intersect beneath a horse's tongue when the bit is placed in the horse's mouth.

21. The bit as set forth in claim 1, wherein the central portion has an increased cross sectional surface area in comparison to adjacent regions of the side portions.

* * * * *